US006138848A

United States Patent [19]

Fermo

[11] Patent Number: 6,138,848

[45] Date of Patent: Oct. 31, 2000

[54] BABY BOTTLE

[76] Inventor: Philip J. Fermo, 43 Craddock Street, Maple, Ontario, Canada, L6A 2R6

[21] Appl. No.: 09/267,023

[22] Filed: Mar. 11, 1999

[51] Int. Cl.[7] ..... A61J 9/00

[52] U.S. Cl. ..... 215/11.1; 215/11.5

[58] Field of Search ..... 215/11.1–11.6; 222/386

[56] References Cited

U.S. PATENT DOCUMENTS

| | | | |
|---|---|---|---|
| 1,532,976 | 4/1925 | Annert | 222/386 X |
| 3,076,574 | 2/1963 | Woodbury, Jr. | 215/11.1 |
| 3,093,256 | 6/1963 | Woodbury, Jr. | 215/11.1 |
| 3,162,318 | 12/1964 | Woodbury, Jr. | 215/11.1 |
| 3,164,303 | 1/1965 | Trautmann | 222/386 X |
| 3,530,979 | 9/1970 | Merrill, Jr. et al. | 215/11.6 X |
| 4,339,046 | 7/1982 | Coen | 215/11.3 X |
| 4,869,381 | 9/1989 | Agner | 215/11.1 |
| 5,078,287 | 1/1992 | Holmes, III | 215/11.6 X |
| 5,385,081 | 1/1995 | Sneddon | 222/386 X |
| 5,598,762 | 2/1997 | Sneddon | 222/386 X |
| 5,799,808 | 9/1998 | Oh | 215/11.1 |
| 5,931,347 | 8/1999 | Haubrich | 222/386 X |

FOREIGN PATENT DOCUMENTS

| | | | |
|---|---|---|---|
| 9460 | 4/1980 | European Pat. Off. | 215/11.1 |
| 699712 | 2/1931 | France | 215/11.4 |
| 3700105 | 7/1988 | Germany | 215/11.2 |

*Primary Examiner*—Sue A. Weaver

[57] ABSTRACT

A baby bottle for storing milk in a substantially air-free environment and dispensing the milk without dispensing air along with the milk. The baby bottle includes a generally cylindrical housing with an open bottom and an open top. The housing is adapted for receiving a fluid therein. A cap portion is coupled to the top of the housing for closing the top of the housing. The cap portion has a nipple which has an aperture therethrough adapted for permitting passage of liquid therethrough. An insert member is slidably disposed in the housing and adapted for sealing a liquid in the housing. The insert member has a plurality of spaced apart grooves extending around an outer perimeter thereof. The insert member has a plurality of sealing bands resting in the grooves of the insert member. The sealing bands engaging an inner surface of the housing for forming a seal therebetween.

7 Claims, 2 Drawing Sheets

BABY BOTTLE

BACKGROUND OF THE INVENTION

1. Field of the Invention

The present invention relates to baby bottles and more particularly pertains to a new baby bottle for storing milk in a substantially air-free environment and dispensing the milk without dispensing air along with the milk.

2. Description of the Prior Art

The use of baby bottles is known in the prior art. More specifically, baby bottles heretofore devised and utilized are known to consist basically of familiar, expected and obvious structural configurations, notwithstanding the myriad of designs encompassed by the crowded prior art which have been developed for the fulfillment of countless objectives and requirements.

The present invention is designed to overcome problems found in baby bottles, especially of the type using a bag in an attempt to reduce intake of air by the child using the bottle. In particular, the bag type bottle require the preparer of the bottle to apply pressure with the fingers to the bag. This may proved difficult, since the fingers may not fit into the shell of the bottle. When left standing, air is allowed to enter the bag. Pressure must be reapplied to the bag or the infant will be fed with air in the bag. Furthermore, bags are disposable and costly.

Known prior art includes U.S. Pat. No. 950,710; U.S. Pat. No. 4,869,381; U.S. Pat. No. 4,880,125; U.S. Pat. No. 5,033,631; U.S. Pat. No. 3,768,683; and U.S. Pat. No. 5,660,359.

While these devices fulfill their respective, particular objectives and requirements, the aforementioned patents do not disclose a new baby bottle. The inventive device includes a generally cylindrical housing with an open bottom and an open top. The housing is adapted for receiving a fluid therein. A cap portion is coupled to the top of the housing for closing the top of the housing. The cap portion has a nipple which has an aperture therethrough adapted for permitting passage of liquid therethrough. An insert member is slidably disposed in the housing and adapted for sealing a liquid in the housing. The insert member has a plurality of spaced apart grooves extending around an outer perimeter thereof. The insert member has a plurality of sealing bands resting in the grooves of the insert member. The sealing bands engaging an inner surface of the housing for forming a seal therebetween.

In these respects, the baby bottle according to the present invention substantially departs from the conventional concepts and designs of the prior art, and in so doing provides an apparatus primarily developed for the purpose of storing milk in a substantially air-free environment and dispensing the milk without dispensing air along with the milk.

SUMMARY OF THE INVENTION

In view of the foregoing disadvantages inherent in the known types of baby bottles now present in the prior art, the present invention provides a new baby bottle construction wherein the same can be utilized for storing milk in a substantially air-free environment and dispensing the milk without dispensing air along with the milk.

The general purpose of the present invention, which will be described subsequently in greater detail, is to provide a new baby bottle apparatus and method which has many of the advantages of the baby bottles mentioned heretofore and many novel features that result in a new baby bottle which is not anticipated, rendered obvious, suggested, or even implied by any of the prior art baby bottles, either alone or in any combination thereof.

To attain this, the present invention generally comprises a generally cylindrical housing with an open bottom and an open top. The housing is adapted for receiving a fluid therein. A cap portion is coupled to the top of the housing for closing the top of the housing. The cap portion has a nipple which has an aperture therethrough adapted for permitting passage of liquid therethrough. An insert member is slidably disposed in the housing and adapted for sealing a liquid in the housing. The insert member has a plurality of spaced apart grooves extending around an outer perimeter thereof. The insert member has a plurality of sealing bands resting in the grooves of the insert member. The sealing bands engaging an inner surface of the housing for forming a seal therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby bottle apparatus and method which has many of the advantages of the baby bottles mentioned heretofore and many novel features that result in a new baby bottle which is not anticipated, rendered obvious, suggested, or even implied by any of the prior art baby bottles, either alone or in any combination thereof.

It is another object of the present invention to provide a new baby bottle which may be easily and efficiently manufactured and marketed.

It is a further object of the present invention to provide a new baby bottle which is of a durable and reliable construction.

An even further object of the present invention is to provide a new baby bottle which is susceptible of a low cost of manufacture with regard to both materials and labor, and which accordingly is then susceptible of low prices of sale to the consuming public, thereby making such baby bottle economically available to the buying public.

Still yet another object of the present invention is to provide a new baby bottle which provides in the apparatuses and methods of the prior art some of the advantages thereof, while simultaneously overcoming some of the disadvantages normally associated therewith.

Still another object of the present invention is to provide a new baby bottle for storing milk in a substantially air-free environment and dispensing the milk without dispensing air along with the milk.

Yet another object of the present invention is to provide a new baby bottle which includes a generally cylindrical housing with an open bottom and an open top. The housing is adapted for receiving a fluid therein. A cap portion is coupled to the top of the housing for closing the top of the housing. The cap portion has a nipple which has an aperture therethrough adapted for permitting passage of liquid therethrough. An insert member is slidably disposed in the housing and adapted for sealing a liquid in the housing. The insert member has a plurality of spaced apart grooves extending around an outer perimeter thereof. The insert member has a plurality of sealing bands resting in the grooves of the insert member, the sealing bands engaging an inner surface of said housing for forming a seal therebetween.

Still yet another object of the present invention is to provide a new baby bottle that eliminates air within a bottle and prevents air from reentering the bottle.

Even still another object of the present invention is to provide a new baby bottle that eliminates the need to wash bags and liners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
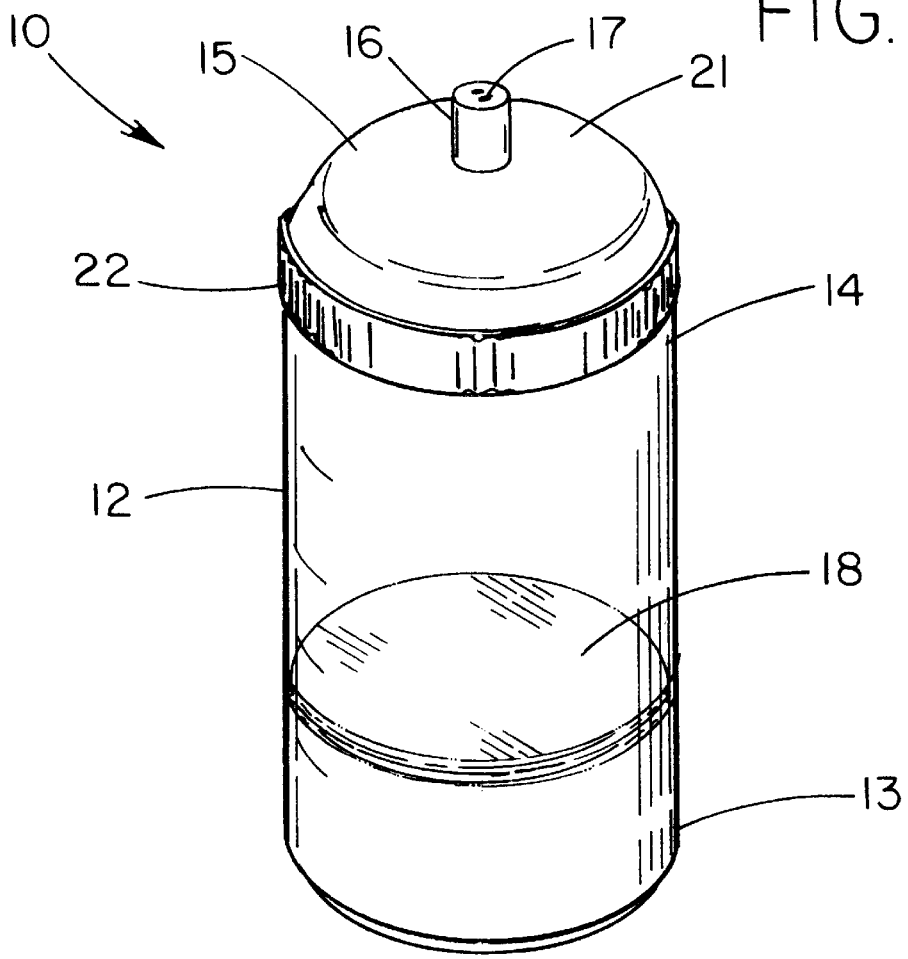
FIG. 1 is a schematic perspective view of a new baby bottle according to the present invention.

With reference now to the drawings, and in particular to FIGS. 1 through 5 thereof, a new baby bottle embodying the principles and concepts of the present invention and generally designated by the reference numeral 10 will be described.

As best illustrated in FIGS. 1 through 5, the baby bottle 10 generally comprises a generally cylindrical housing 12 with an open bottom 13 and an open top 14. The housing is adapted for receiving a fluid therein. A cap portion 15 is coupled to the top of the housing for closing the top of the housing. The cap portion has a nipple 16 which has an aperture 17 through it adapted for permitting passage of liquid therethrough when suction is applied to the nipple. An insert member 18 is slidably disposed in the housing and adapted for sealing a liquid in the housing. The insert member has a plurality of spaced apart grooves 19 extending around an outer perimeter thereof. The insert member has a plurality of sealing bands 20 resting in the grooves of the insert member. The sealing bands engage an inner surface of the housing for forming a seal therebetween.

Preferably, an inner diameter of the housing is continuous between the top and bottom of the housing to permit removal of the insert member from the housing via either the top or the bottom. Exemplary quantities of the housing are 4 ounces and 8 ounces.

The top of the housing may be externally threaded to which the cap portion would be threadedly coupled. Preferably, the nipple extends from a domed center 21 of the cap portion.

The cap portion may have protrusions 22 extending from an outer perimeter of the cap portion that frictionally engage a hand to ease tightening and removal of the cap portion from the housing.

An insert member is slidably disposed in the housing and adapted for sealing a liquid in the housing. Preferably, the insert member has three spaced apart grooves extending around an outer perimeter thereof. Ideally, a first of the grooves 23 is positioned adjacent a first planar surface of the insert member, a second of the grooves 24 is positioned adjacent a second planar surface of the insert member, and a third of the grooves 25 is positioned between the first and second of the grooves.

Preferably, the sealing bands are resiliently deformable, such as being made of rubber.

Three spaced apart grooves and sealing bands are preferred because this arrangement prevents tilting of the insert member in the housing, which could result in a leak or introduction of air. Even with two sealing bands, the insert member could tilt. The claimed positioning helps prevent tilting of the insert member as well as prevents waste. Because the first and second of the sealing bands are positioned adjacent the planar surfaces of the insert member, little fluid rests between the insert member and the inner surface of the housing. Rather, most is held above the insert member.

Figure 2:
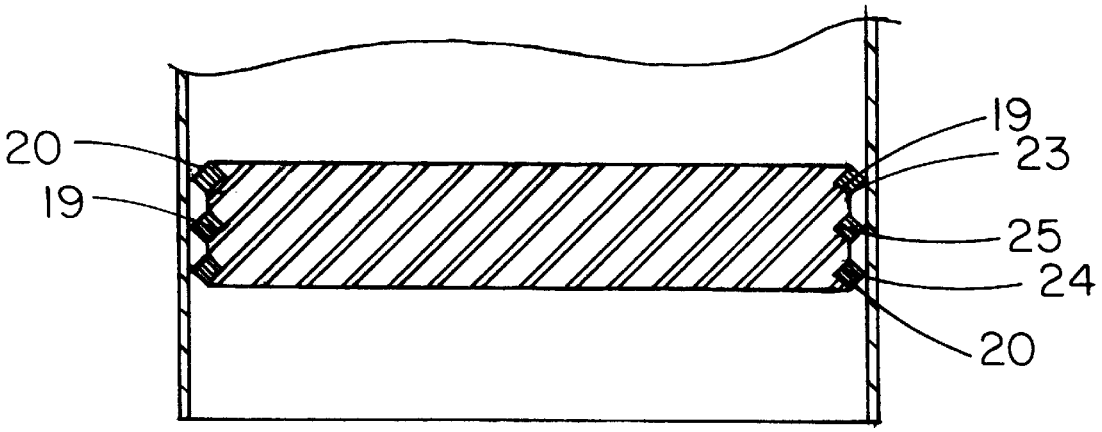
FIG. 2 is a schematic partial cross sectional view of the present invention.

As seen in FIG. 2, each of the sealing bands has a generally rectangular transverse cross section. The cornered edges of the bands form a better seal with the inner surface of the housing than would a round band. This is because of the squeegee effect created by the cornered edge. Furthermore, the rectangular shape of the sealing bands helps the sealing bands to stay in the grooves and resist removal therefrom.

Figure 3:
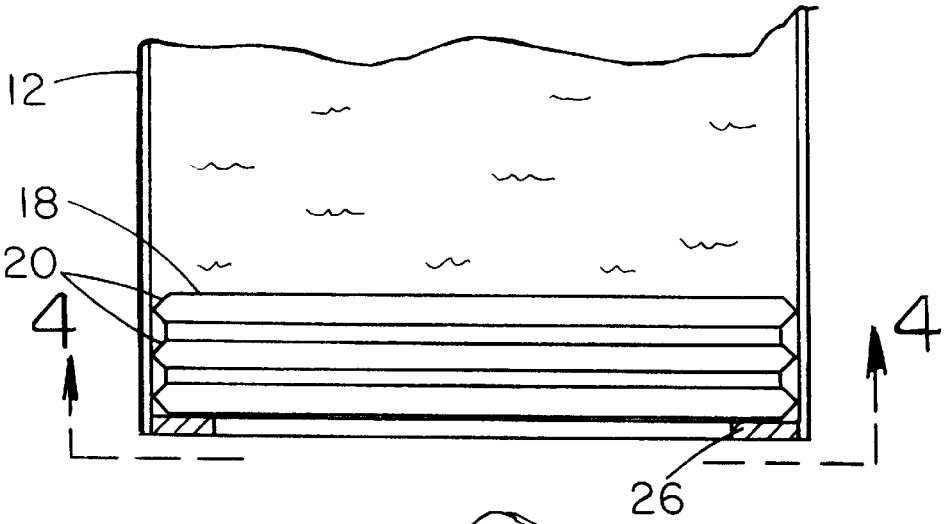
FIG. 3 is a schematic detailed side view of the present invention.
Figure 4:
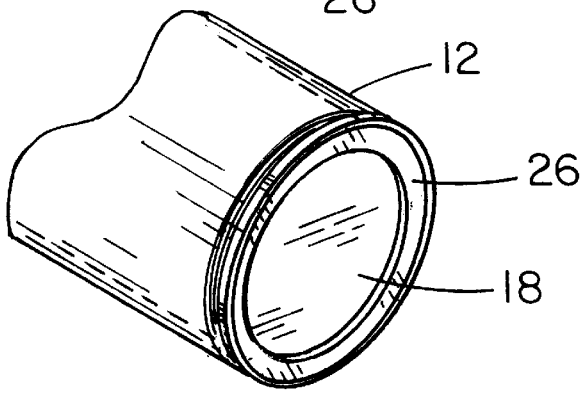
FIG. 4 is a schematic perspective view of the present invention taken from line 4—4 of FIG. 3.
Figure 5:
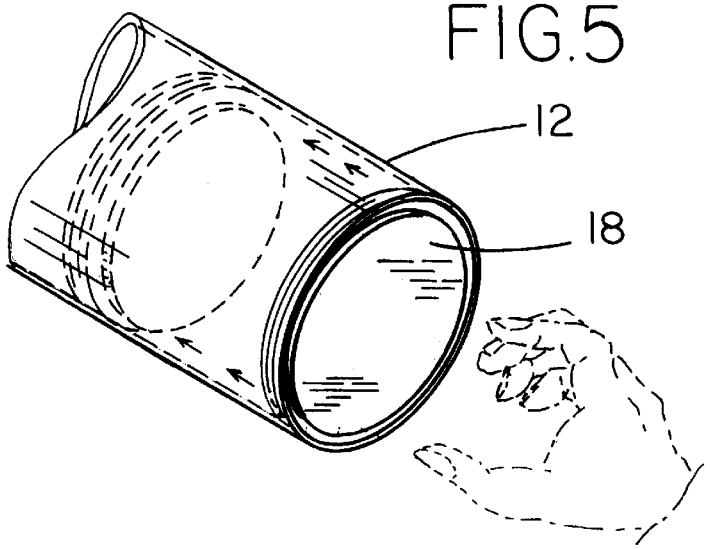
FIG. 5 is a schematic perspective view of the present invention.

Optionally, as shown in FIGS. 3 and 4, a stop ring 26 may extend around the bottom of the housing to prevent the insert member from being removed from the bottom of the housing.

In use, the insert member is inserted in the bottom of the housing. Liquid is poured in the top of the housing. The lid is attached to the top of the housing. The housing is held upright so that any air bubbles collect towards the nipple. The insert member is pushed towards the cap to force any air in the housing out through the nipple. Once the air is removed, the bottle may be given to a child. As the child sucks fluid from the housing, the insert member is automatically drawn towards the cap with the fluid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby bottle, comprising:

a generally cylindrical housing having an open bottom and an open top, said housing being adapted for receiving a fluid therein;

a cap portion being coupled to said top of said housing for closing said top of said housing, said cap portion having a nipple, said nipple having an aperture therethrough adapted for permitting passage of liquid therethrough;

an insert member being slidably disposed in said housing and adapted for sealing a liquid in said housing;

said insert member having at least three spaced apart grooves extending around an outer perimeter thereof;

said insert member having at least three sealing bands resting in said grooves of said insert member, said sealing bands engaging an inner surface of said housing for forming a seal therebetween such that said sealing bands facilitate the maintaining of an orthogonal relationship between said insert member and said housing thereby preventing spillage of liquid between said insert member and said cap portion.

2. The baby bottle of claim 1, wherein an inner diameter of said housing is continuous between said top and bottom of said housing for permitting removal of said insert member from said housing through either said top or said bottom of said housing.

3. The baby bottle of claim 1, wherein a first of said grooves is positioned adjacent a first planar surface of said insert member, a second of said grooves being positioned adjacent a second planar surface of said insert member.

4. The baby bottle of claim 3, wherein a third of said grooves is positioned between said first and second of said grooves.

5. The baby bottle of claim 1, wherein each of said sealing bands has a generally rectangular transverse cross section.

6. The baby bottle of claim 1, further comprise a stop ring being positioned proximate said open end of said housing for preventing removal of said insert member from said bottom of said housing, said stop ring having a central aperture for facilitating access to the insert member.

7. A baby bottle, comprising:

a cylindrical housing having an open bottom and an open top, said housing being adapted for receiving a fluid therein;

wherein an inner diameter of said housing is continuous between said top and bottom of said housing;

a cap portion being coupled to said top of said housing for closing said top of said housing, said cap portion having a nipple extending from a domed center thereof, said nipple having an aperture therethrough adapted for permitting passage of liquid therethrough;

said cap portion having protrusions extending from an outer perimeter of said cap portion for frictionally encagaing a hand to facilitate tightening and removal of said cap portion from said housing;

an insert member being slidably disposed in said housing and adapted for sealing a liquid in said housing;

said insert member having at least three spaced apart grooves extending around an outer perimeter thereof, a first of said grooves being positioned adjacent a first planar surface of said insert member, a second of said grooves being positioned adjacent a second planar surface of said insert member, a third of said grooves being positioned between said first and second of said grooves;

said insert member having at least three resiliently deformable sealing bands resting in said grooves of said insert member, said sealing bands engaging an inner surface of said housing for forming a seal therebetween such that said sealing bands facilitate the maintaining of an orthogonal relationship between said insert member and said housing thereby preventing spillage of liquid between said insert member and said cap portion;

each of said sealing bands having a generally rectangular transverse cross section; and a stop ring being positioned proximate said open end of said housing for preventing removal of said insert member from said bottom of said housing, said stop ring having a central aperture for facilitating access to the insert member.

* * * * *